United States Patent [19]

Green

[11] 4,341,598

[45] Jul. 27, 1982

[54] FLUIDIZED COAL PYROLYSIS APPARATUS

[75] Inventor: Norman W. Green, Upland, Calif.

[73] Assignee: Occidental Research Corporation, Irvine, Calif.

[21] Appl. No.: 164,818

[22] Filed: Jun. 30, 1980

Related U.S. Application Data

[60] Division of Ser. No. 66,312, Aug. 14, 1979, Pat. No. 4,280,876, which is a continuation of Ser. No. 873,010, Oct. 27, 1978, abandoned.

[51] Int. Cl.[3] ..... C10B 1/04; C10B 43/14; C10B 49/22

[52] U.S. Cl. ..... 202/99; 202/108; 202/121

[58] Field of Search ..... 201/9, 12, 16, 29, 31; 48/210; 110/245; 34/10, 57 A; 432/14, 15, 58; 202/99, 121, 108

[56] References Cited

U.S. PATENT DOCUMENTS

| | | | |
|---|---|---|---|
| 2,577,632 | 12/1951 | Roetheli | 201/31 X |
| 2,582,711 | 1/1952 | Nelson | 48/DIG. 4 |
| 2,709,675 | 5/1955 | Phinney | 201/31 |
| 2,955,077 | 10/1960 | Welinsky | 201/28 |
| 4,039,390 | 8/1977 | Logan | 201/12 |
| 4,047,883 | 9/1977 | Waters | 432/14 |
| 4,064,018 | 12/1977 | Choi | 201/12 |
| 4,070,250 | 1/1978 | Choi | 201/12 |
| 4,191,539 | 3/1980 | Patel et al. | 48/210 |

*Primary Examiner*—Bradley Garris
*Attorney, Agent, or Firm*—Forrest E. Logan; Max Geldin

[57] ABSTRACT

Method and apparatus for pyrolyzing agglomerative coals which comprises introducing a fluidized bed of hot char particles into a pyrolysis chamber or reactor, and injecting upwardly into the chamber a high velocity jet of agglomerative coal particles in a carrier gas, the fluidized hot char particles surrounding the high velocity coal jet and heating the coal particles to yield gaseous products and char. The hot char particles in the fluidized state and disposed around the coal jet are entrained in the upwardly expanding coal jet and mixed with the coal particles, so that by the time the coal particles contact the pyrolysis chamber wall, such coal particles being heated by the char have passed through the tacky state and are no longer tacky and do not adhere to the chamber wall. The gaseous product and char formed during pyrolysis are rapidly removed from the pyrolysis chamber, and such char can be separated, e.g. in a cyclone, reheated and introduced into the fluidized bed of char particles as a fresh source of heat. The hot char particles from the fluidized bed which are entrained in the coal jet are removed from the pyrolysis chamber with the gaseous product, without any appreciable recirculation or mixing of such entrained char particles back into the fluidized char within the pyrolysis chamber.

3 Claims, 3 Drawing Figures

FLUIDIZED COAL PYROLYSIS APPARATUS

This is a division of application Ser. No. 66,312, filed Aug. 14, 1979, now U.S. Pat. No. 4,280,876, which is a continuation of Ser. No. 873,010, filed Oct. 27, 1978, now abandoned.

BACKGROUND OF THE INVENTION

This invention relates to a method and apparatus to permit the pyrolysis of an agglomerative or a caking coal without plugging of the pyrolysis or reactor chamber by solid products of the pyrolysis reaction.

The use of fluidized systems wherein a fluidized stream is formed of finely divided coal particles, heated char particles and a carrier stream to pyrolyze the coal particles to extract the volatiles therefrom is well known in the art. In such prior art processes the heated char particles and/or the gas stream are utilized to provide the requisite heat of pyrolysis to the coal particles with a supply of char continuously being produced upon pyrolysis of the coal in the system.

Agglomerative particulate bituminous coals are well known to those skilled in the art due to the tendency of such coals to plasticize and become sticky at relatively low temperatures, e.g. 550° to 850° F. When such prior art processes have been applied to agglomerative bituminous coal, problems have arisen due to the agglomerative nature of such coal. Thus, when the coal particles are heated as noted above to their plastic state, and the particles in such condition make contact with the walls of the reactor, the particles cake thereon to form a bubbly compact mass which swells and then resolidifies, forming a solid coherent body with a porous structure, that is, coke. Such agglomeration of coal particles on the reactor walls causes severe blockage in the system and renders the system inoperable.

In an effort to overcome the blockage or plugging problems encountered in pyrolysis systems utilizing agglomerative coals, various procedures have been suggested by the prior art. Thus, in U.S. Pat. Nos. 2,955,077 and 3,375,175 the agglomerative particulate coal is preheated in a conventional fluidized bed at temperatures ranging from 600° F. to 825° F. for periods ranging from 1 to 30 minutes to remove at least a portion of the volatiles from the coal so that the coal can be further pyrolyzed to recover the volatiles therefrom. The requirement of preheating agglomerative bituminous coals in these processes for relatively long residence times imposes severe economic limitations on these processes.

U.S. Pat. No. 3,357,896 discloses heating large particles of caking coal through their plastic range in a free fall system to avoid contact with the reactor walls and produce non-caking coal char. The patent also discloses the use of oxygen in the heating gas to prevent caking of the coal while it is heated through its plastic range. However, such treatment with oxygen has the disadvantage that it substantially reduces the yield of hydrocarbons produced during pyrolysis. It is desirable to obtain as product of the pyrolysis reaction a maximum yield of liquid or gaseous hydrocarbons.

In Squires U.S. Pat. Nos. 3,597,327 and 3,855,070, coal is introduced into a fluidized bed of coke pellets of relatively large size ranging from about 1/12" to about ½" in diameter. Such coal particles are heated almost instantly to the reaction temperature and become sticky, and are captured by and accrete upon the pellets, forming a smear upon the surface of the pellets.

Nelson U.S. Pat. No. 2,582,711 discloses introduction of coal and char into the bottom of a draft tube of a recirculating bed of char. The coal is conveyed upwardly in the draft tube and induces the upward flow of char in the draft tube and the internal recirculation of the char diluent. Heat to the system is supplied by means of hot fuel gas.

Other patents illustrating prior art pyrolysis and carbonization processes and systems include Phinney, U.S. Pat. No. 2,709,675 and Landers, U.S. Pat. No. 3,455,789.

However, to applicant's knowledge, many of the prior art processes and systems have been unsatisfactory and relatively few of such prior art processes and systems have been practiced commercially.

In my copending application, Ser. No. 633,898, filed Nov. 20, 1975, now U.S. Pat. No. 4,163,693 there is disclosed a mixing apparatus for mixing particulate materials, such as a turbulent jet stream of coal and a fluidized char stream and passing the resulting turbulent mixture stream of char and coal through a reactor to produce gaseous products. The coal stream is directed downwardly into the upper end of a mixing section which communicates with a reactor, and entrains and mixes with heated recycled char fed from an annular fluidizing chamber. It is stated therein that those coals which exhibit a plastic or tacky state will lose their tackiness upon being heated sufficiently. Thus, by heating the primary entraining stream of coal particles sufficiently during contact with the secondary or entrained hot char recycle stream in such jet mixer apparatus, sufficient heat is transferred to the coal particles to get such materials through the tacky state rapidly enough after mixing to avoid the plugging problem.

It is an object of the invention to provide an efficient economical and continuous method and apparatus for pyrolyzing agglomerative coals in a pyrolysis chamber or reactor for recovery of volatile hydrocarbons under conditions which prevent plugging of the reactor. A particular object is the provision of a process and apparatus for rapidly heating agglomerative coal during pyrolysis under conditions to permit passage of the coal through the tacky or plastic state prior to impingement of the pyrolyzed solid residue on the reactor walls, thus avoiding formation of coke deposits on the reactor walls and formation of a plug within the reactor, while also avoiding thermal decomposition of the gaseous hydrocarbon products and obtaining high yields thereof. Yet another particular object is to provide a process of the above type and an apparatus, utilizing therein as a heat source a fluidized bed of char surrounding a jet of coal particles, without appreciable recirculation of the char entrained in the coal jet within the pyrolysis chamber.

SUMMARY OF THE INVENTION

According to the invention there is provided a continuous process for the pyrolysis of agglomerative coals to recover a high yield of volatiles in the form of liquid and gaseous hydrocarbons without plugging the reactor by deposition of solid particles on the walls thereof. It is known that when fine coal is rapidly heated to carbonization temperatures, the duration in which the coal is capable of agglomeration and adhering to the walls of the reactor is very short. In the present invention, coal, which is entrained in a gas is injected upwardly at a high velocity in the form of a fluid jet in a carrier gas into a zone of hot solid particles, e.g. char particles, maintained in the fluidized state. The hot solid particles or hot char in the fluidized state and surrounding the high velocity fluid coal jet is entrained by the upwardly expanding coal jet and is mixed with the coal particles, such that by the time the heated coal particles reach the walls of the reactor they are no longer tacky and therefore will not adhere to the wall of the reactor. The volatiles including gaseous hydrocarbons and entrained hot solid particles or hot char, are rapidly removed from the reactor and recovered as product.

The velocity of the coal in the high velocity fluid jet or jet stream of coal particles is very high, for example, about 80 ft. per second, as contrasted to the much lower velocity of prior art processes, such as the velocity of about 5 to 30 ft. per second of the stream of coal particles in the carrier gas disclosed in the above Phinney patent.

In accordance with a feature of the present invention process and system, the source of heat, namely the hot solids, e.g. the hot char, is introduced and maintained as a fluidized bed uniformly around the upwardly expanding fluid jet of coal, and such hot char particles are mixed with and entrained in the fluid coal jet within the confined of the reactor, and such entrained solids or char particles are removed from the pyrolysis chamber with the pyrolysis products, without any appreciable recirculation of such entrained char solids back into the fluidized bed within the reactor.

The gaseous products of pyrolysis or carbonization, and char, together with the entraining and fluidizing gases, are withdrawn from the pyrolysis reactor and conveyed to suitable treatment zones, e.g. cyclone separation means, following which the separated solids or char is partially combusted and returned to the fluidized bed in the reactor to supply the heat for the pyrolysis reaction, while gaseous and liquid hydrocarbon products of the pyrolysis reaction are recovered.

The above procedure and system is in contrast to the above Nelson patent, employing an internal char recirculation system within the pyrolysis reactor.

As noted above, the heating of the coal particles to a temperature through and well above the tacky state of the coal is accomplished preferably by the use of hot char, and preferably hot recycled char, produced in the pyrolysis. However, other hot particulate solids maintained in a non-recirculating fluidized bed according to the invention can be employed as a source of heat for the coal.

In a broad sense, the invention accordingly provides a process for the pyrolysis of agglomerative coal in a pyrolysis chamber, which comprises maintaining a zone of hot solid particles in the fluidized state in the pyrolysis chamber, injecting upwardly in such chamber a high velocity jet of agglomerative coal particles in a carrier gas, the fluidized hot solid particles surrounding the high velocity coal jet and heating the coal particles to yield gaseous products and char, the hot solid particles in the fluidized state being entrained by the upwardly expanding coal jet and mixed with the coal particles, so that by the time the coal particles contact the pyrolysis chamber wall, the last-mentioned particles are no longer tacky, and rapidly removing the gaseous products and entrained solid particles from the pyrolysis chamber.

More specifically, the present invention provides a process for the pyrolysis of agglomerative coals in a pyrolysis chamber, which comprises introducing into and maintaining in said chamber a fluidized bed of hot char particles, said char particles being fluidized with a fluidizing gas substantially free of molecular oxygen, injecting upwardly into said chamber and through said fluidized bed of hot char particles a high velocity upwardly expanding jet stream comprised of agglomerative coal particles and a carrier gas substantially free of molecular oxygen, said fluidized bed of hot char being maintained substantially uniformly around said coal jet stream and heating said coal particles through the tacky state thereof and carbonizing said coal particles to yield gaseous products and char, said hot char particles being entrained in the upwardly expanding coal jet stream and mixed with the coal particles, rapidly removing said gaseous products and char from said pyrolysis chamber, said hot char particles entrained in said coal jet stream being removed from said pyrolysis chamber with said gaseous products without any appreciable recirculation within said chamber of said entrained char particles back into the fluidized bed, separating the char from said gaseous products, and reheating and recirculating at least a portion of said char to said fluidized bed of hot char in said pyrolysis chamber.

The invention also embodies a pyrolysis chamber or system for carrying out the above process.

BRIEF DESCRIPTION OF THE DRAWING

The invention will be described in greater detail below taken in connection with the accompanying drawing wherein.

DETAILED DESCRIPTION OF PREFERRED EMBODIMENTS

Figure 1:
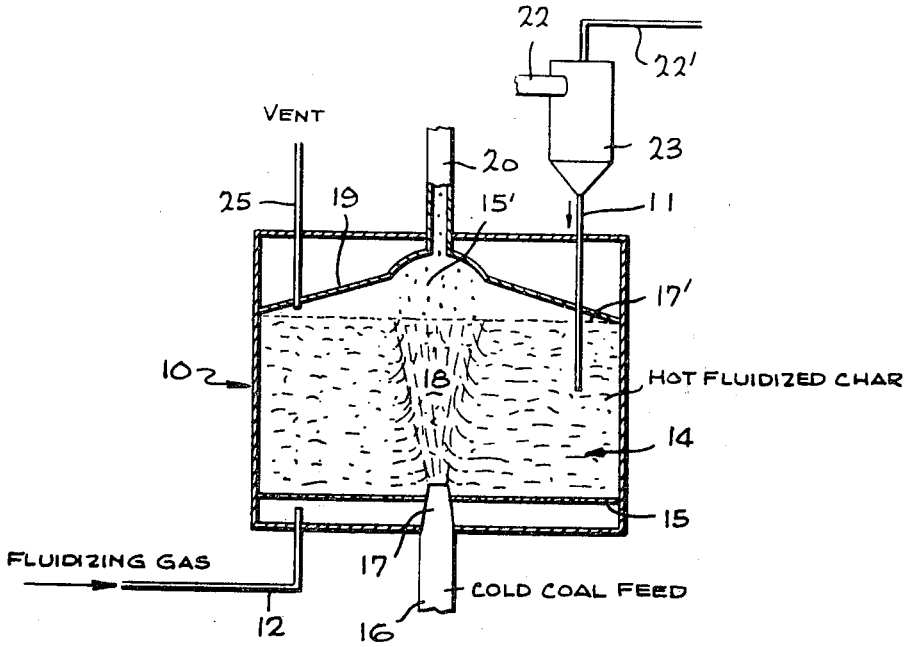
FIG. 1 is a sectional elevation of a reactor for pyrolysis of coal according to one preferred embodiment of the invention.

According to the method of the present invention, in preferred practice product char at an elevated temperature is used as a source of heat for the pyrolysis reaction which takes place in a pyrolysis chamber 10, referring to FIG. 1 of the drawing. Such hot char is introduced through a standpipe 11 and maintained in the pyrolysis reactor or chamber 10 in the fluidized state by means of a fluidizing gas introduced at 12 into the bottom of the reactor below a gas distributor means such as horizontal porous or perforated plate 15 or a pipe grid. The fluidizing gas introduced at 12 is pressurized sufficiently so that upon passage or injection thereof through the perforated plate 15, sufficient motion is imparted to the char particles introduced at 11 to maintain such particles in a fluidized state. Thus, there is provided in the reactor 10 a fluidized zone or bed of hot char particles, indicated at 14, supported above the perforated plate 15.

A fluid stream of particulate coal or coal particles is fed through an inlet pipe 16 into the bottom of the reactor and is discharged from the upper end of the pipe 16 through a nozzle 17 substantially centrally into the reactor 10 above the perforated plate 15. The stream of coal particles in a carrier gas, indicated at 18, is injected upwardly at high velocity into the pyrolysis reactor and substantially centrally through the fluidized bed of char 14 therein. A high level of turbulence is maintained in the fluid jet by injecting the coal stream into the pyrolysis reactor preferably at a high velocity corresponding to a Reynolds flow index number greater than 2,000. As the fluid coal jet 18 expands upwardly through the fluidized bed of char 14 maintained above plate 15 in the reactor, the particles of hot char in the fluidized bed 14 substantially uniformly surround the outer periphery of the coal jet, and the particles of char mix thoroughly with the fluid coal jet to heat the coal rapidly through the tacky state and pyrolyze or carbonize the coal, yielding volatile hydrocarbon products and char. The hot char that is mixed with and entrained by the expanding coal jet stream is carried out of the reactor and does not mix appreciably back into the main bed of fluidized char.

The volatile hydrocarbon products and solid char particles produced in the reactor by carbonization are collected in the space 15' above the upper level 17' of the fluidized bed of char 14 and below an upper baffle 19, and are continuously discharged from the reactor via pipe 20 for processing to recover volatile hydrocarbons and to reheat and recycle the char to the reactor 10. This can be accomplished by separating the char from the gaseous products in a cyclone separator (not shown) and partially combusting the separated char in a char burner (not shown) to supply heat to the char, as described in detail hereinafter. The heated char is then recycled at 22 to a cyclone 23 for separation of char from flue gases discharged via line 22', and the separated char is introduced via standpipe 11 to the pyrolysis reactor, to replenish fluidized char discharged from the reactor with pyrolysis products. A vent 25 is provided which communicates with the space above the fluidized bed of char 14 in the reactor, and which also communicates with the above noted cyclone (not shown) for separating char from gaseous products from the reactor, as further described below.

The coal particles in the upwardly expanding fluid jet of coal 18 in the reactor, and which have the critical contact time with respect to the hot char in terms of avoiding reactor plugging are those particles on the periphery of the fluid jet. As previously noted, the hot char particles in the fluidized bed are entrained and mixed with the coal particles in the upwardly expanding coal jet so that by the time the coal particles contact the pyrolysis chamber wall such particles have passed through the tacky state and are no longer tacky, and thus will not stick or adhere to the walls of the reactor.

The diameter of the fluidized bed of char 14 in the reactor is chosen sufficiently large to contain the coal jet 18 so that it does not strike the side walls of the reactor. The fluidized bed of char 14 is chosen deep enough so that the fluid jet of coal 18 does not break through such bed while the coal particles are still in the tacky state.

Although only one fluid coal jet 18 is shown, a plurality of such fluid jets can be positioned within a single fluidized bed of char.

Any suitable carrier gases can be employed in the invention process to carry out the pyrolysis of the coal particles. Such gases, used either as the fluidizing gas to provide the fluidized bed of char particles, or as the carrier gas for the coal particles to provide the fluid jet of coal, should be substantially free of molecular oxygen, such as air, oxygen, and the like, so as not to deleteriously affect the proportion of volatile materials extracted from the coal. Examples of suitable gases for use as carrier gases in the invention process include chemically inert gases such as nitrogen and argon, and also gases such as methane, hydrogen, carbon monoxide, carbon dioxide, steam, and any other gas which will not deleteriously react with or oxidize the organic portion of the matter within the system, including hydrocarbon product gases produced in the pyrolysis.

This invention is designed for the use of agglomerative particulate coals, which generally are bituminous coals. Such coals are well known to those skilled in the art due to their tendency to plasticize and become sticky at relatively low temperatures, i.e., 550°-850° F. The term "agglomerative" coals in the present invention is meant to include bituminous coals as well as all other coals which may be agglomerative. The coal particles found useable in the invention can be prepared by any conventional method which will produce coal particles of the requisite size.

The particulate char which is preferably added to the particulate coal generally provides the main source of heat for the pyrolysis and also aids in preventing agglomeration. The temperature of such char for this purpose generally ranges from about 1100° to in excess of 2,000° F., e.g. about 2,200° F., usually about 1100° to about 1600° F. The selection of a particular char-to-coal weight ratio will of course be dependent both upon the heat transfer requisites of the system as well as upon the degree of agglomerativeness of the coal particles. The particulate char to coal weight ratio can vary broadly, but is usually at least 3:1, and can be as high as 20 to 1. Preferably, such ratio ranges from about 5 to 1 to about 10 to 1. Here again, the particular ratio is chosen in relation to desired temperature and particle size of the coal, and other conditions to prevent agglomeration. Particle size of the particulate coal should be generally less than about 32 mesh (Tyler mesh), and is selected with respect to reaction geometry and pyrolysis temperature. The char can have a particle size of the same general order as the coal particles, but larger particle size diluent solids can be utilized. The solids content of the jet stream of carrier gas and coal should range from about 0.1 to about 60% by volume based on the total volume of the stream in the pyrolysis zone.

The pyrolysis system is essentially designed to heat the agglomerative coal particles to a temperature ranging from about 900° to about 2,000° F., preferably about 1,000° to about 1,400° F., to remove the maximum amount of volatiles therefrom and obtain high yields thereof while at the same time reducing the agglomerative tendency or tacky time of the coal. The selection of a particular temperature within this range will be dependent upon a number of factors, including the particular type of coal employed and the residence time of the coal particles in the pyrolysis zone.

The effluent from the pyrolysis zone is composed of (1) char, (2) product gas comprising volatilized hydrocarbons, water vapor and product gases, e.g. such as hydrogen, carbon monoxide, carbon dioxide and the like, and (3) the carrier gas which can comprise pyrolysis products. The char solids can be readily separated therefrom by any conventional solids/gas separator such as a cyclone separator and the like. The volatilized hydrocarbons and water vapor can be separated and recovered by conventional separation and recovery means.

By the term "volatilized hydrocarbons" as used in this application is meant that part of the product gases produced by pyrolysis of the coal which are hydrocarbons. A part of the volatilized hydrocarbons can be condensed. After the condensible hydrocarbons and any undesirable gaseous products have been removed from the product gases, the scrubbed hydrocarbon gases can be utilized as the carrier gas or at least as a portion thereof to contribute to the overall efficiency of the system.

Factors which tend to reduce the agglomeration of the coal and to reduce the tacky time for the coal include the use of a larger weight ratio of char to coal, higher temperature of the char or higher reactor temperature and smaller coal particle size. The geometry or sizing of the reactor is chosen with respect to the above factors.

Figure 2:
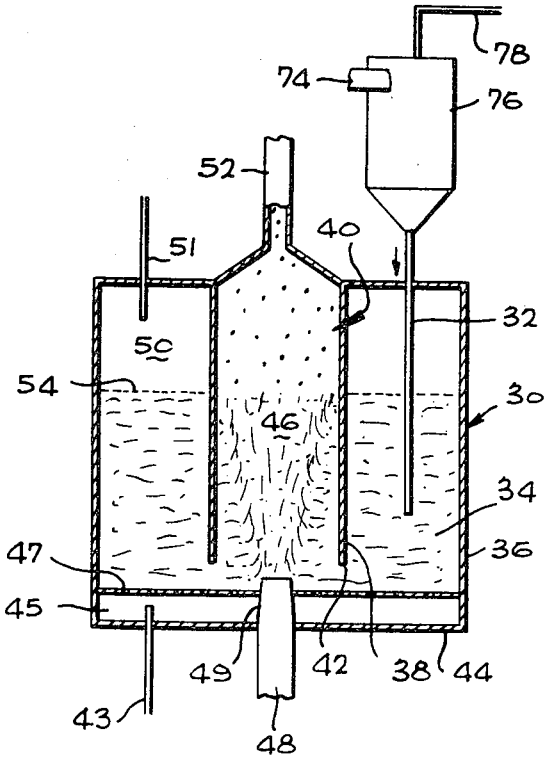
FIG. 2 is a sectional elevation of another form of reactor for pyrolysis according to another preferred embodiment.

According to another preferred embodiment of the invention referring to FIG. 2, a pyrolysis reactor 30 is provided to which the char which was previously subjected to combustion or other form of heating is returned by means of a standpipe 32. The char thus recycled is returned to an annulus 34 in the reactor, formed between the outer wall 36 thereof and an inner wall 38 of an internal pyrolysis chamber 40 within the reactor 30. The lower edge 42 of the walls of the internal chamber 40 extends above and is spaced from the perforated plate 47 above the bottom 44 of the reactor.

The entire body of char within the annulus 34 and in the reaction or devolatilization zone of the chamber 40 is maintained as a fluidized bed employing a fluidizing gas, as noted above. The fluidizing gas is introduced at 43 into the bottom portion 45 of the reactor below the perforated plate 47. The hot char in chamber 40 is entrained in the high velocity coal jet stream 46 introduced through the bottom pipe 48 and nozzle 49 into the reactor, and is simultaneously replaced by char from the annulus 34. The annulus 34 is sufficiently large in cross-section to serve as a surge container for char in the event of minor upsets, that is, in case of an interruption of recycling of char through pipe 32. A high level of turbulence, corresponding to a Reynolds number greater than 2,000, is maintained in the coal jet 46 until the coal has exited the plastic or tacky state.

Volatile products and char formed in the pyrolysis reaction are discharged via pipe 52 for separation of char and volatile products by means of a cyclone separator and partial combustion and reheating of at least a portion of the separated char, followed by recycling of such partially combusted char and flue gases via line 74 to a cyclone 76, as described in detail below in connection with FIG. 3. The so separated char then passes into the char standpipe 32, and returned to the fluidized char bed 34. Flue gases from cyclone 76 are vented through pipe 78.

A freeboard space 50 is provided above the level 54 of the fluid bed of char in the annulus 34, from which pressure release can be provided by means of a vent 51.

Figure 3:
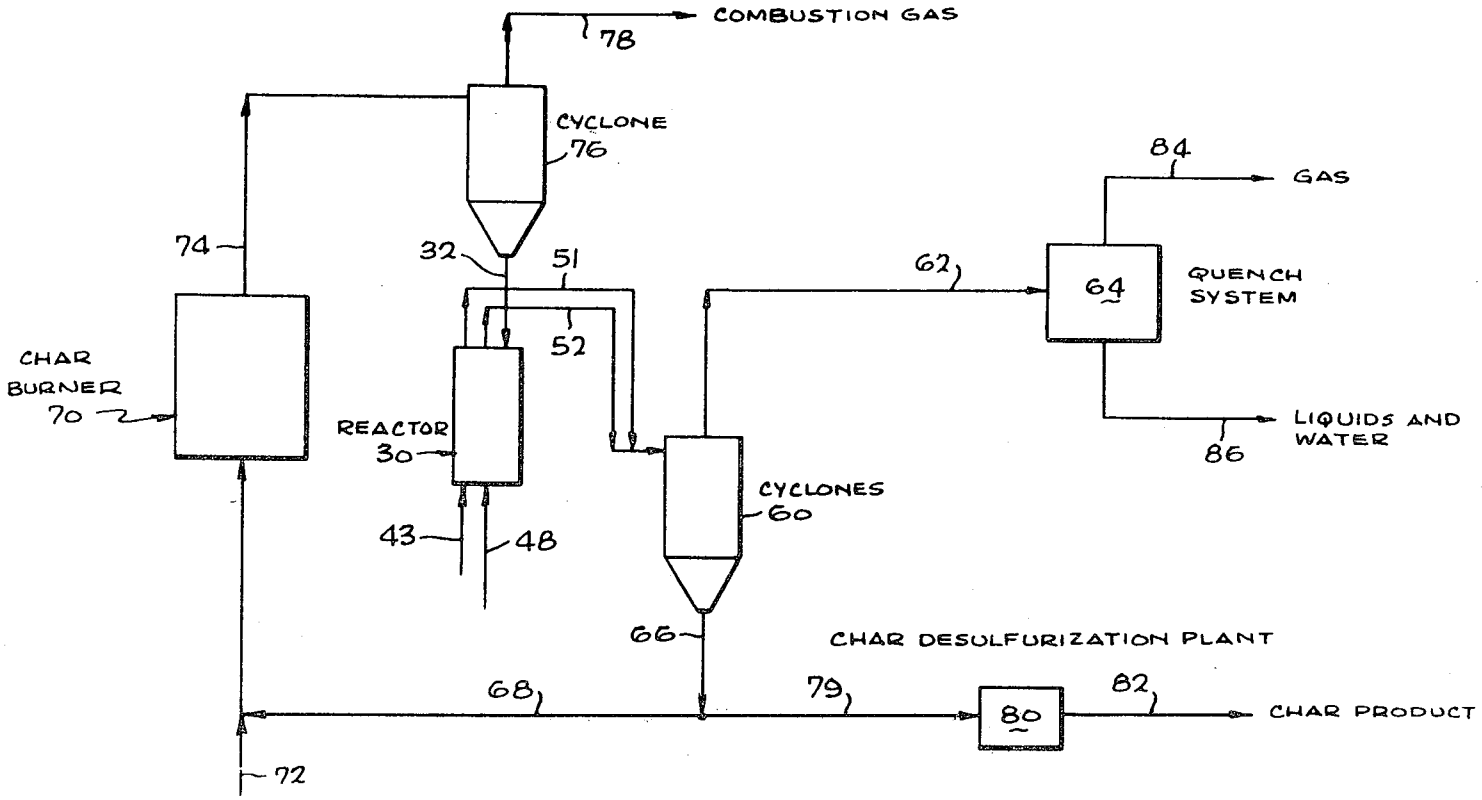
FIG. 3 is a flow sheet of a preferred process for pyrolysis of agglomerative coal according to the invention, employing the pyrolysis reactor of FIG. 2.

Referring to FIG. 3 of the drawing, in a process or system employing a pyrolysis reactor of the type indicated, e.g. at 30 in FIG. 2 of the drawing, coal is pulverized and dried and is then transported pneumatically for introduction via 48 into the bottom of the pyrolysis reactor 30, in the form of a fluid jet 46, as shown in FIG. 2. In the pyrolysis reactor 30 the fluid jet of coal particles is mixed with recycled char in the fluidized state, as noted above. The recycled char heats the coal particles to a temperature ranging from about 900° to about 2,000° F., preferably between about 1,000° and about 1,400° F., the hot recycled by-product char at 32 (see FIG. 2) thus providing the heat for pyrolysis. The coal is heated to its decomposition temperature within a fraction of a second, e.g. 0.1 second. The volatilized products from the pyrolysis reactor 30, including char, are conducted via line 52 into cyclones, as illustrated at 60 in FIG. 3, and additional gases flow via vent 51 from the fluidized bed of char in reactor 30 to such cyclones. The effluent gaseous products at 62 from cyclones 60, are rapidly quenched at 64 to avoid any secondary decomposition. The char 66 exiting the cyclones at 60 is transported via 68 to a char burner 70 where the char is partially combusted with air introduced at 72 into the char burner, raising the temperature of the char therein, e.g. to about 1,350° F. The char from char burner 70 is then recycled at 74 to the cyclone indicated at 76 for removal of flue gases at 78 (see also FIG. 2), and the resulting char is then fed at 32 back into the pyrolysis reactor 30.

A portion of the char from cyclones 60 can be conveyed at 79 to a char desulfurization plant 80 and the purified char product removed at 82.

The pyrolysis vapors are quenched at 64 to recover product gas at 84 and to cool, condense and collect the product tars or liquids, including water, at 86. These liquids can then be upgraded into marketable fuel by hydrogenation. The non-condensible product gas at 84 is used for fuel and production of hydrogen.

The excess char recovered in the process may be desulfurized and used as a clean solid fuel or gasified and the resultant gas purified. Since this char will not agglomerate, it is suitable for gasification by processes currently known in the art.

In the above described process it is seen, however, that at least a portion of the product char is used as a carrier to supply heat directly to the pyrolysis reactor in a continuous flow system.

Another feature of the present process is the capability for processing caking coals in one step without pretreatment, while avoiding plugging of the pyrolysis reactor. This is accomplished by taking advantage of the rapid heatup of the fine coal particles obtained by char heating, particularly by the use of a fluid jet reactor of the type herein described.

From the foregoing, it is seen that the present invention affords procedure and a pyrolysis reactor which permits rapid heating and pyrolysis of particulate coal to produce gaseous products and char, and wherein a high velocity jet of agglomerative coal particles is injected upwardly in the reactor, the coal particles being heated rapidly and carbonized, by means of a fluidized bed of char, the char being introduced uniformly around the coal and mixed and entrained therein without appreciable recirculation of such entrained char back to the fluidized bed of char within the reactor, so that the coal particles pass through the tacky state and are no longer tacky when they impinge upon the wall of the reactor, thereby avoiding adherence of solid carbonized particles to the wall of the reactor and avoiding plugging of the reactor. Volatile products and char, including the char introduced from the fluidized bed, are continuously rapidly discharged from the pyrolysis reactor, the char is separated from the gaseous products, partially combusted and recycled to the fluidized char bed in the reactor to supply the required heat for pyrolysis.

While I have described particular embodiments of my invention for purposes of illustration, it is understood that other modifications and variations will occur to those skilled in the art, and the invention accordingly is not to be taken as limited except by the scope of the appended claims.

What is claimed is:

1. An apparatus for the pyrolysis in a pyrolysis chamber of agglomerative coal particles which pass through a tacky state during pyrolysis without the formation of deposits on the pyrolysis chamber wall, which comprises:

(a) a pyrolysis chamber having a lower part;

(b) a first inlet means operative for introducing a pressurized fluidizing gas into said lower part of said pyrolysis chamber;

(c) a porous or perforated plate disposed in said lower part of said pyrolysis chamber above said first inlet means, and operative for permittng such pressurized fluidizing gas to flow substantially uniformly through said plate and operative for maintaining a fluidized bed of hot char particles in said pyrolysis chamber;

(d) an outer chamber, said pyrolysis chamber being positioned within said outer chamber and forming an annular space between said outer chamber and said pyrolysis chamber, said porous or perforated plate also being disposed in the lower part of said annular space, said pyrolysis chamber being positioned above said porous or perforated plate so that there is a clearance space between said pyrolysis chamber and said porous or perforated plate, (e) a standpipe positioned in said annular space and which is operative for receiving from a source and discharging such hot char particles into said annular space, wherein said porous or perforated plate is also operative for maintaining a fluidized bed of such hot char particles in said annular space by such introduction of such pressurized fluidized gas through said first inlet means, and wherein said pyrolysis chamber is in communication with said outer chamber in such a way that it is operative for permitting such hot char particles maintained in such a fluidized bed in said annular space to flow from said annular space through said clearance space and into said pyrolysis chamber above said plate, but wherein said pyrolysis chamber is not in communication with said outer chamber at the upper portion thereof above said fluidized bed of hot char particles in said annular space.

(f) a second inlet means in communication with said pyrolysis chamber operative for introducing agglomerative coal particles and a carrier gas into said lower part of said pyrolysis chamber and into the bottom of such a fluidized bed of hot char particles maintained in said pyrolysis chamber;

(g) a nozzle in communication with said second inlet means and operative for injecting upwardly and substantially centrally into such fluidized bed of hot char particles maintained in said pyrolysis chamber a high velocity fluid jet stream of such agglomerative coal particles in a carrier gas, said nozzle being operative for forming an upwardly expanding turbulent jet stream comprising such agglomerative coal particles and an entrained part of such hot char particles, and for heating such agglomerative coal particles by the transfer of heat from such entrained part of such hot char particles to such agglomerative coal particles so that by the time such agglomerative coal particles contact said pyrolysis chamber wall such agglomerative coal particles will no longer be in a tacky state which is sufficient to form a deposit on said pyrolysis chamber wall, and operative for producing a product char and gaseous products from such heated agglomerative coal particles;

(h) an outlet means connected to and in communication with said pyrolysis chamber and operative for removal from said pyrolysis chamber of a combined stream comprising such gaseous products and such carrier gas, and char solids comprising such product char and such entrained part of such hot char particles, but inoperative for removal of such hot char particles which have not been entrained in such upwardly explaining turbulent jet stream;

(i) a first cyclone separator in communication with said outlet means and operative for separating such char solids from such combined gaseous stream and for producing an effluent gas stream, said first cyclone separator having a solids outlet; and (j) a recycle means spaced between and in communication with the solids outlet of said first cyclone separator and said standpipe which is operative for recycling such separated char solids to said standpipe, wherein said recycle means comprises a char burner having an outlet, and a second cyclone separator having an inlet and a solids outlet, said char burner being in communication with the solids outlet of said first cyclone separator, said char burner being operative for reheating by partial combustion of at least part of such separated char solids and operative for forming such hot char particles and a combustion gas, wherein the outlet of said char burner is in communication with the inlet to said second cyclone separator, said cyclone separator being operative for separating such hot char particles from such combustion gas, and wherein the solids outlet of said second cyclone separator is in communication with said standpipe.

2. An apparatus for the pyrolysis in a pyrolysis chamber of agglomerative coal particles which pass through a tacky state during pyrolysis, without the formation of deposits on the pyrolysis chamber wall, which comprises:

(a) a pyrolysis chamber having a lower part;

(b) an outer chamber, said pyrolysis chamber being positioned within said outer chamber and forming an annular space between said outer chamber and said pyrolysis chamber;

(c) a first means operative for maintaining, a fluidized bed of hot solid particles in said pyrolysis chamber, and also operative for maintaining a fluidized bed of such hot solid particles in said annular space, and wherein said pyrolysis chamber is in communication with said outer chamber in such a way that it is operative for permitting such hot solid particles maintained in a fluidized bed in said annular space to flow from said annular space under the lower end of said pyrolysis chamber and into said pyrolysis chamber, but wherein said pyrolysis chamber is not in communication with said outer chamber at the upper portion thereof above such fluidized bed of hot solid particles in said annular space;

(d) a standpipe positioned in said annular space and which is operative for discharging hot solid particles into said annular space;

(e) an inlet means in communication with said pyrolysis chamber operative for introducing agglomerative coal particles into the bottom of such a fluidized bed maintained in said pyrolysis chamber;

(f) a nozzle means connected to and in communication with said inlet means and operative for injecting upwardly and substantially centrally, into such a fluidized bed of hot solid particles maintained in said pyrolysis chamber, a high velocity fluid jet stream of agglomerative coal particles, and for forming an upwardly expanding turbulent jet stream comprising such agglomerative coal particles and an entrained part of such hot solid particles, and for heating such agglomerative coal particles by the transfer of heat from such entrained part of such hot solid particles to such agglomerative coal particles so that by the time such agglomerative coal particles contact said pyrolysis chamber wall such agglomerative coal particles will no longer be in a tacky state which is sufficient to form a deposit on said pyrolysis chamber wall, and for producing char solids and a product gas from such agglomerative coal particles; and (g) an outlet means connected to and in communication with said pyrolysis chamber and operative for removal from said pyrolysis chamber of such product gas, such char solids and such entrained part of such hot solids particles, without any appreciable recirculation of such last mentioned hot solid particles back into such fluidized bed within said pyrolysis chamber, but not operative for the removal of such hot solid particles which have not been entrained in such upwardly expanding turbulent jet stream.

3. An apparatus for the pyrolysis in a pyrolysis chamber of agglomerative coal particles which pass through a tacky state during pyrolysis without the formation of deposits on the pyrolysis chamber wall, which comprises:

(a) a pyrolysis chamber having a lower part;

(b) a first inlet means operative for introducing a pressurized fluidizing gas into said lower part of said pyrolysis chamber;

(c) a porous or perforated plate disposed in said lower part of said pyrolysis chamber above said first inlet means, and operative for permitting such pressurized fluidizing gas to flow uniformly through said plate and operative for maintaining a fluidized bed of hot char particles in said pyrolysis chamber;

(d) an outer chamber, said pyrolysis chamber being positioned within said outer chamber and forming an annular space between said outer chamber and said pyrolysis chamber, said porous or perforated plate also being disposed in the lower part of said annular space, said pyrolysis chamber being positioned above said porous or perforated plate so that there is a clearance space between said pyrolysis chamber and said porous or perforated plate;

(e) a standpipe in said annular space and which is operative for receiving from a source and discharging such hot char particles into said annular space, wherein said porous or perforated plate is also operative for maintaining a fluidized bed of such hot char particles in said annular space by such introduction of such pressurized fluidized gas through said first inlet means, and wherein said pyrolysis chamber is in communication with said outer chamber in such a way that it is operative for permitting such hot char particles maintained in a fluidized bed in said annular space to flow from said annular space through said clearance space and into said pyrolysis chamber, but wherein said pyrolysis chamber is not in communication with said outer chamber at the upper portion thereof above such fluidized bed of hot char particles in said annular space;

(f) a second inlet means in communication with said pyrolysis chamber operative for introducing agglomerative coal particles and a carrier gas into said lower part of said pyrolysis chamber and into the bottom of such a fluidized bed of hot char particles maintained in said pyrolysis chamber;

(g) a nozzle in communication with said second inlet means and operative for injecting upwardly and substantially centrally into such fluidized bed of hot char particles maintained in said pyrolysis chamber a high velocity fluid jet stream of such agglomerative coal particles in a carrier gas, said nozzle being operative for forming an upwardly expanding turbulent jet stream comprising such agglomerative coal particles and an entrained part of such hot char particles, and for heating such agglomerative coal particles by the transfer of heat from such entrained part of such hot char particles to such agglomerative coal particles so that by the time such agglomerative coal particles contact said pyrolysis chamber wall such agglomerative coal particles will no longer be in a tacky state which is sufficient to form a deposit on said pyrolysis chamber wall, and operative for producing a product char and gaseous products from such heated agglomerative coal particles;

(h) an outlet means connected to and in communication with said pyrolysis chamber and operative for removal from said pyrolysis chamber of a combined stream comprising such gaseous products and such carrier gas, and char solids comprising such product char and such entrained part of such hot char particles, without any appreciable recirculation of such last mentioned hot char particles back into such fluidized bed within said pyrolysis chamber, but inoperative for removal of such hot char particles which have not been entrained in such upwardly expanding turbulent jet stream;

(i) a first cyclone separator in communication with said outlet means and operative for separating such char solids from such combined stream and for producing an effluent gas stream, said first cyclone separator having a solids outlet; and (j) a recycle means spaced between and in communication with the solids outlet of said first cyclone separator and said standpipe which is operative for recycling such separated char solids to said standpipe.

* * * * *